US009890613B2

(12) United States Patent
Parker et al.

(10) Patent No.: US 9,890,613 B2
(45) Date of Patent: Feb. 13, 2018

(54) METHOD AND DEVICE FOR REMOVING DEPOSITS FROM A FORMATION FLUID OR GAS TRANSPORTATION MEANS

(71) Applicant: BLUE SPARK ENERGY INC., Calgary (CA)

(72) Inventors: Todd Parker, Calgary (CA); Shawn Carroll, Calgary (CA); Dan Skibinski, Calgary (CA)

(73) Assignee: Blue Spark Energy Inc., Calgary (CA)

( * ) Notice: Subject to any disclaimer, the term of this patent is extended or adjusted under 35 U.S.C. 154(b) by 276 days.

(21) Appl. No.: 14/697,476

(22) Filed: Apr. 27, 2015

(65) Prior Publication Data

US 2015/0308233 A1 Oct. 29, 2015

Related U.S. Application Data

(60) Provisional application No. 61/985,250, filed on Apr. 28, 2014.

(51) Int. Cl.

| | |
|---|---|
| ***E21B 37/00*** | (2006.01) |
| ***B06B 1/02*** | (2006.01) |
| ***B08B 9/032*** | (2006.01) |
| ***B08B 7/02*** | (2006.01) |
| ***B08B 9/00*** | (2006.01) |

(52) U.S. Cl.

CPC ..... *E21B 37/00* (2013.01); *B08B 7/02* (2013.01); *B08B 9/00* (2013.01); *B08B 9/032* (2013.01)

(58) Field of Classification Search

CPC .. B08B 7/02; B08B 9/00; B08B 9/032; E21B 37/00

See application file for complete search history.

(56) References Cited

U.S. PATENT DOCUMENTS

| | | | | |
|---|---|---|---|---|
| 5,004,050 | A * | 4/1991 | Sizonenko | E21B 43/003 166/248 |
| 5,948,171 | A * | 9/1999 | Grothaus | B08B 3/12 134/1 |
| 9,567,840 | B2 * | 2/2017 | Parker | E21B 43/26 |
| 2010/0071898 | A1 * | 3/2010 | Corre | E21B 33/12 166/264 |
| 2011/0139440 | A1 * | 6/2011 | Zolezzi-Garreton | E21B 28/00 166/249 |
| 2014/0305877 | A1 * | 10/2014 | Cioanta | E21B 28/00 210/739 |
| 2015/0308233 | A1 * | 10/2015 | Parker | B08B 7/02 134/1 |

FOREIGN PATENT DOCUMENTS

| | | | | |
|---|---|---|---|---|
| CA | 2889226 | A1 * | 10/2015 | B08B 7/02 |
| EP | 2940244 | A1 * | 11/2015 | E21B 37/00 |
| EP | 2977545 | A1 * | 1/2016 | E21B 37/08 |
| MX | 2015005413 | A * | 3/2016 | B08B 7/02 |

* cited by examiner

*Primary Examiner* — Daniel Pihulic

(74) *Attorney, Agent, or Firm* — Klein, O'Neill & Singh, LLP

(57) ABSTRACT

Systems and methods for removing deposits from a component of a formation fluid and/or gas transportation tubing string. The disclosed systems and methods generate at least one shock wave into a shock wave transmitting liquid into the transportation tubing string nearby to the component and propagate the at least one shock wave toward the component for removing deposits from the component.

14 Claims, 4 Drawing Sheets

METHOD AND DEVICE FOR REMOVING DEPOSITS FROM A FORMATION FLUID OR GAS TRANSPORTATION MEANS

FIELD OF ART

The field of the invention relates to the cleaning of a fluid transportation means and, more particularly, to a method and device for removing deposits from a fluid or gas transportation means in order to improve the transportation and/or the recovery of formation fluids and/or gases.

A preferred application of the invention concerns removing mineral deposits from components of a completion string arranged in a borehole of a subterranean formation. Another preferred application of the invention concerns removing mineral deposits from a surface oil or gas piping.

BACKGROUND

In the art of petroleum production, a borehole is drilled into the earth through the oil or gas producing subterranean formation or, for some purposes, through a water bearing formation or a formation into which water or gas is to be injected. Once produced from the borehole, oil and gas can be transported using pipelines.

Completion of a well may be carried out in a number of ways dependent upon the nature of the formation of interest. Where the formation itself or formations above the formation of interest have a tendency to disintegrate and/or cave into the hole, a cylindrical metallic casing is normally set in the well through the formation of interest and the cylindrical metallic casing is then perforated adjacent the formation of interest.

In order to produce formation fluids or gases, completion strings are arranged in the borehole. Such a completion string generally comes as a production tubing which comprises a plurality if different components such as, e.g. safety valves, sliding side doors, side pocket mandrels etc. . . . .

Similarly, a pipeline comes as a production tubing which may comprise a plurality of different components such as e.g. metallic tubes, pipeline valves etc. . . . .

In any event, after a period of production, injection or transportation of fluids or gases, there is a tendency for the components of the completion string and/or pipelines to become plugged with various types of residues. For example, organic residues like paraffin, asphalts and other gummy residues of petroleum origin often cause plugging problems.

Usually these deposits can cause significant problems, because of their composition and the fact that they can precipitate under certain conditions (pressure, temperature, composition). These materials of mineral or organic origins either together with chemicals from water, normally produced with the oil, such as, calcium carbonate, calcium sulfate, barium sulfate, sulfur and the like, or such chemicals themselves have a tendency to form extremely hard deposits on different parts of the components.

Such deposits can adhere to various components in a borehole wellbore or a pipeline, restricting their use seriously and/or reducing or completely preventing the flow of fluids or gases through the completion string or the pipeline. For example, deposits may prevent opening or closing safety valves or sliding side doors, etc Such deposits are difficult to dissolve by known chemical means or to dislodge by known mechanical means. For example, chemical treatments, such as, treatments with acids, surface active agents and the like have been utilized in order to clean out scaled components. However, such techniques, while less expensive than a complete workover, are substantially less effective, since they are incapable, in most cases, of dissolving significant amounts of the plugging materials. Another technique, which can be classified as a mechanical technique and has also been suggested for the purpose of cleaning components, includes using brushes, scrapers or pigs. Such equipment allows only removing most of the encrusted deposits in areas of the components which are easily accessible. However, brushes, scrapers or pigs are quite inefficient removing encrusted deposits in areas of the components accessible with difficulty or inaccessible.

Consequently, it is often necessary to rework the well and replace one or several components of the completion string or the pipeline. Such tactics are, of course, both time-consuming and expensive.

It is therefore an object of the present invention to provide an improved method and device for efficiently and effectively cleaning components of a completion string arranged in a borehole extending into the earth or of a transportation pipeline. Another and further object of the present invention is to provide an improved method and device for removing deposits encrusted on components of a completion string arranged in a borehole or of a transportation pipeline, in particular in areas of the components which are accessible with difficulty or inaccessible to mechanical means such as brushes, scrapers or pigs. Yet another object of the present invention is to provide an improved method and device for increasing the production of fluids or gases from a subsurface earth formation or increasing the injectivity of fluids or gases into such formations or the transportation of fluids or gases into a pipeline.

SUMMARY

The present invention concerns a method for removing deposits, in particular mineral deposits, from a component of a formation fluid or gas transportation means, such as e.g. a component of a completion string arranged in a borehole of a subterranean formation or a component of a transportation pipeline, said formation fluid or gas containing hydrocarbons, said method comprising the steps of:

generating at least one shock wave into a shock wave transmitting liquid into said transportation means nearby said component; and propagating said at least one shock wave toward the component for removing deposits from said component.

The at least one propagated shock wave allows efficiently and rapidly removing deposits from the component. In particular, the at least one propagated shock wave may reach areas of the component which are accessible with difficulty or inaccessible to mechanical means such as brushes, scrapers or pigs.

In a preferred embodiment, the shock wave transmitting liquid is at least partially delimited by a membrane into said transportation means and the at least one shock wave is propagated through said membrane toward the component for removing deposits from said component. Such a membrane improves the effectiveness of the propagation from the liquid to the component.

In an embodiment according to the invention, a series of at least ten shock waves is generated. This allows efficiently removing deposits from the component.

In a preferred embodiment, a plurality of series of shock waves is generated, each series of shock waves being generated at different locations of the transportation means, for example different heights of a completion string. Preferably, the different locations are regularly spaced.

Using a plurality of series of shock waves allows advantageously removing most of the deposits from a component, between 80-95% and preferably more than 95% of the deposits.

The invention also concerns a shock wave generation device for removing deposits, in particular mineral deposits, from a component of a formation fluid or gas transportation means, such as e.g. a component of a completion string arranged in a borehole of a subterranean formation or a component of a transportation pipeline, said formation fluid or gas containing hydrocarbons, said device comprising:

a chamber which is at least partially filled with a shock wave transmitting liquid and which is adapted to be arranged into said transportation means nearby said component; and an electrical discharge unit for generating at least one electrical discharge that propagates at least one shock wave into said shock wave transmitting liquid said component for removing deposits from said component.

Advantageously, the at least one propagated shock wave allows efficiently and rapidly removing deposits from the component. In particular, the at least one propagated shock wave may reach areas of the component which are accessible with difficulty or inaccessible to mechanical means such as brushes, scrapers or pigs.

In a preferred embodiment, the chamber is at least partially delimited by a membrane and the electrical discharge unit is configured for generating at least one electrical discharge that propagates at least one shock wave into said shock wave transmitting liquid through said membrane nearby said component for removing deposits from said component.

The membrane improves the effectiveness of the propagation from the liquid to the component. Moreover, such a membrane isolates the liquid in the chamber from elements of the transportation means surrounding the shock wave generating device, such as e.g. mud or other fluids, while maintaining acoustic coupling with the component. Such a flexible membrane prevents thus the deposits and other elements from damaging electrodes and other components (insulators) of the electrical discharge unit.

Preferably, the membrane is deformable and/or flexible and/or elastic in order to conduct efficiently the shock wave toward the component.

In an embodiment according to the invention, the membrane is made of fluorinated rubber or other fluoroelastomer.

In an embodiment according to the invention, the relative elongation of the membrane is at least 150%, preferably at least 200% in order to be used efficiently in oils, fuels, liquid reservoirs, aliphatic or aromatic hydrocarbons etc. . . . .

In an embodiment according to the invention, the membrane is operable between −35° C. and 250° C. in order to be used in oils, fuels, liquid reservoirs, aliphatic and/or aromatic hydrocarbons etc. . . . .

In a preferred embodiment according to the invention, the electrical discharge unit comprises a power conversion unit, a power storage unit, a discharge control unit and a discharge system.

Preferably, the discharge system comprises a first electrode and a second electrode for generating a high voltage arc in the shock wave transmitting liquid.

Furthermore, shock wave fracturing does not require pressure greater than the fracture gradient pressure advantageously reducing cost, complexity and time of operation.

Preferably, the at least one shock wave propagates radially.

In another embodiment, the at least one shock wave propagates in a predetermined direction.

The invention also concerns a system for removing deposits, in particular mineral deposits, from a component of a formation fluid or gas transportation means, such as e.g. a component of a completion string arranged in a borehole of a subterranean formation or a component of a transportation pipeline, said formation fluid or gas containing hydrocarbons, said system comprising:

a shock wave generation device as previously described;

a wireline coupled to said shock wave generation device for inserting said shock wave generation device in the transportation means nearby said component;

a voltage source located external of the transportation means; and an electrical circuit within said wireline for connecting said voltage source to the shock wave generation device.

The invention also concerns a well for recovering formation fluids or gases from a subterranean formation, said well comprising a system as previously described and a completion string comprising at least one component such as, e.g. a safety valve, a side pocket mandrel, a sliding side sleeves, etc. . . . .

The invention also concerns a transportation pipeline for transporting formation fluids or gases, such as e.g. a surface pipeline, said pipeline comprising a system as previously described and at least one component such as, e.g. a tubing portion, a pipeline valve, etc. . . . .

BRIEF DESCRIPTION OF THE DRAWINGS

These and other features, aspects, and advantages of the present invention are better understood with regard to the following Detailed Description of the Preferred Embodiments, appended Claims, and accompanying Figures, where:

Figure 1:
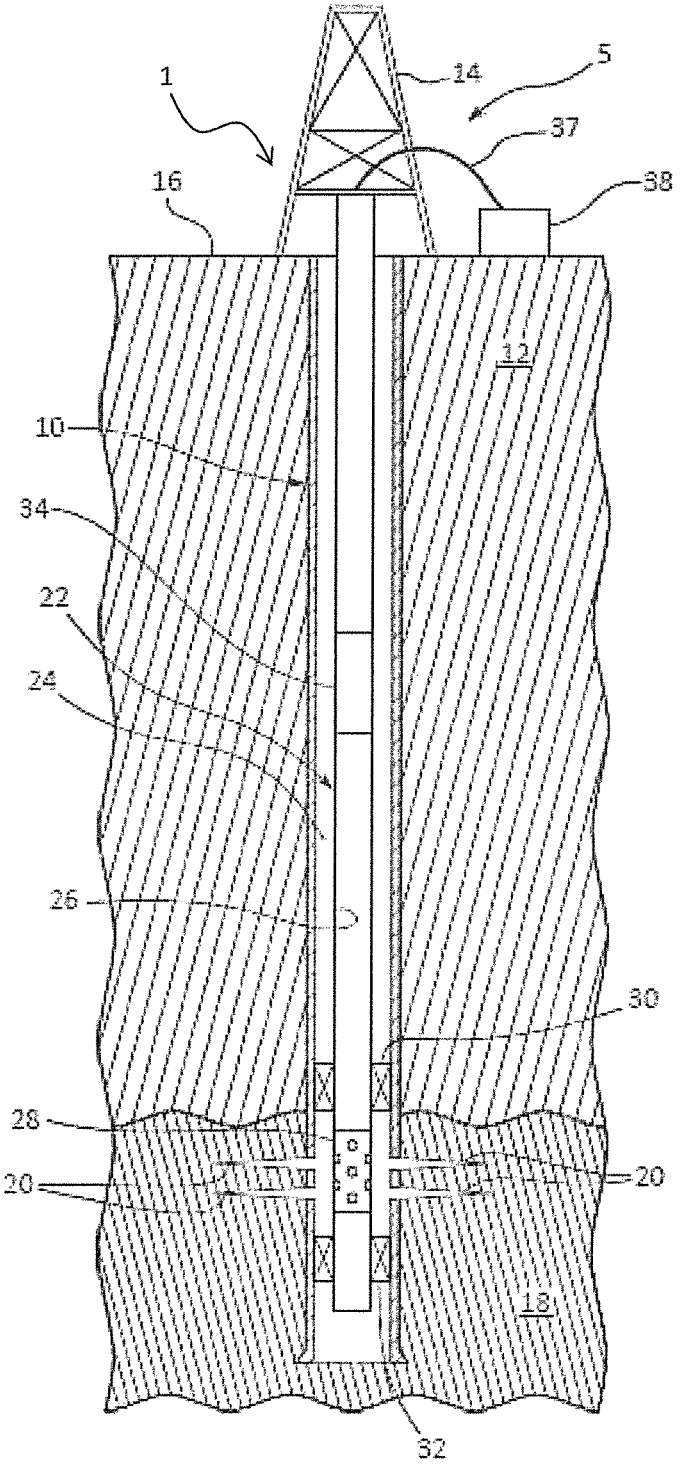
FIG. 1 illustrates a cross-sectional view of a borehole comprising a completion string.

In the accompanying Figures, similar components or features, or both, may have the same or a similar reference label.

DETAILED DESCRIPTION

The Specification, which includes the Summary of Invention, Brief Description of the Drawings and the Detailed Description of the Preferred Embodiments, and the appended Claims refer to particular features (including process or method steps) of the invention. Those of skill in the art understand that the invention includes all possible combinations and uses of particular features described in the Specification.

Those of skill in the art understand that the invention is not limited to or by the description of embodiments given in the Specification. The inventive subject matter is not restricted except only in the spirit of the Specification and appended Claims.

Those of skill in the art also understand that the terminology used for describing particular embodiments does not limit the scope or breadth of the invention. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this invention belongs unless defined otherwise.

As used in the Specification and appended Claims, the singular forms "a", "an", and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced. The verb "couple" and its conjugated forms means to complete any type of required junction, including electrical, mechanical or fluid, to form a singular object from two or more previously non-joined objects. If a first device couples to a second device, the connection can occur either directly or through a common connector. "Optionally" and its various forms means that the subsequently described event or circumstance may or may not occur. The description includes instances where the event or circumstance occurs and instances where it does not occur. "Operable" and its various forms means fit for its proper functioning and able to be used for its intended use.

Spatial terms describe the relative position of an object or a group of objects relative to another object or group of objects. The spatial relationships apply along vertical and horizontal axes. Orientation and relational words including "uphole" and "downhole"; "above" and "below"; "up" and "down" and other like terms are for descriptive convenience and are not limiting unless otherwise indicated.

Where the Specification or the appended Claims provide a range of values, it is understood that the interval encompasses each intervening value between the upper limit and the lower limit as well as the upper limit and the lower limit. The invention encompasses and bounds smaller ranges of the interval subject to any specific exclusion provided.

Where the Specification and appended Claims reference a method comprising two or more defined steps, the defined steps can be carried out in any order or simultaneously except where the context excludes that possibility.

The invention is described hereunder in reference to a well for producing formation fluids or gases such as e.g. oil. This does not limit the scope of the present invention which may be used for removing deposits from any tubing or piping such as e.g. a surface pipeline.

As shown in FIG. 1, an exemplary well 1 for recovering hydrocarbons comprises a borehole 10 which is drilled through the earth 12 from a drilling rig 14 located at the surface 16. The borehole 10 is drilled down to a hydrocarbon-bearing subterranean formation 18 and perforations 20 extend outwardly into the formation 18.

An exemplary completion string 22 extends within the borehole 10 from the surface 16. An annulus 24 is defined between the completion string 22 and a wall of the surrounding borehole 10. The completion string 22 may be made up of sections of interconnected production tubing components such as e.g. tubes, sliding side doors, side pocket mandrels, flow couplings, landing nipples, wireline entry guide, locator seal assemblies etc . . . known from the person skilled in the art.

A production flowbore 26 passes along a length of the production tubing string 22 for the transport of production fluids from the formation 18 to the surface 16. A ported section 28 is incorporated into the completion string 22 and is used to flow production fluids from the surrounding annulus 24 to the flowbore 26. Packers 30, 32 secure the completion string 22 within the borehole 10.

In this example, the completion string 22 comprises a surface-controlled subsurface safety valve ("SCSSV") 34. The surface-controlled subsurface safety valve 34 is used to close off fluid flow through the flowbore 26 and may include a flapper valve 35, as will be described with respect to FIG. 2. The general construction and operation of flapper valves is well known in the art. Flapper valve assemblies are described, for example, in U.S. Pat. No. 7,270,191 by Drummond et al. entitled "Flapper Opening Mechanism" and U.S. Pat. No. 7,204,313 by Williams et al. entitled "Equalizing Flapper for High Slam Rate Applications" which are herein incorporated by reference in their entireties.

The invention is describes in its application to removing deposits from a surface-controlled subsurface safety valve 34, in particular mineral deposits. This does not limit the scope of the present invention as the device and method according to the invention may be used for removing deposits from any other components of a completion string 22 such as the ones previously mentioned or more generally of any tubing or piping such as e.g. a surface pipeline.

The well 1 comprise a system 5 for removing deposits from a component of the completion string 22. The system 5 comprises a shock wave generation device 36, a wireline 37 coupled to said shock wave generation device 36 for raising and lowering said shock wave generation device 36 in the completion string 22 nearby the surface-controlled subsurface safety valve 34, a voltage source 38 located external of the borehole 10 and an electrical circuit within said wireline 37 for connecting said voltage source 38 to the shock wave generation device 36.

Figure 2:
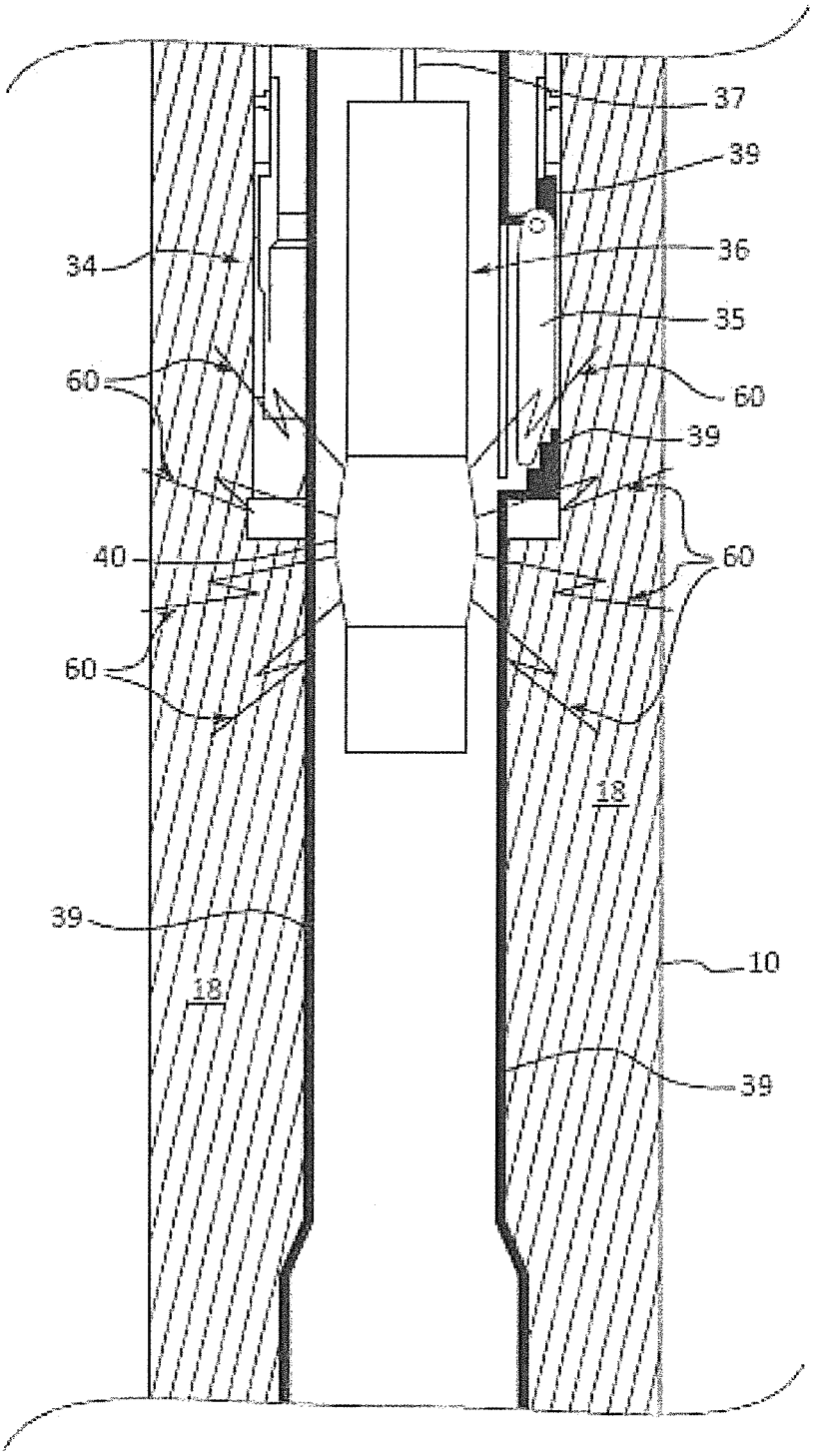
FIG. 2 illustrates a cross-sectional view of an embodiment of the shock wave generation device according to the invention located nearby a safety valve.

Turning now to FIG. 2, an exemplary embodiment of a tubular surface-controlled subsurface safety valve 34 of a completion string 22 is shown. A significant amount of deposits 39 is encrusted in different areas of the surface-controlled subsurface safety valve 34 prior to applying the method according to the invention. A shock wave generation device 36 according to the invention is located inside said tubular surface-controlled subsurface safety valve 34.

Figure 3:
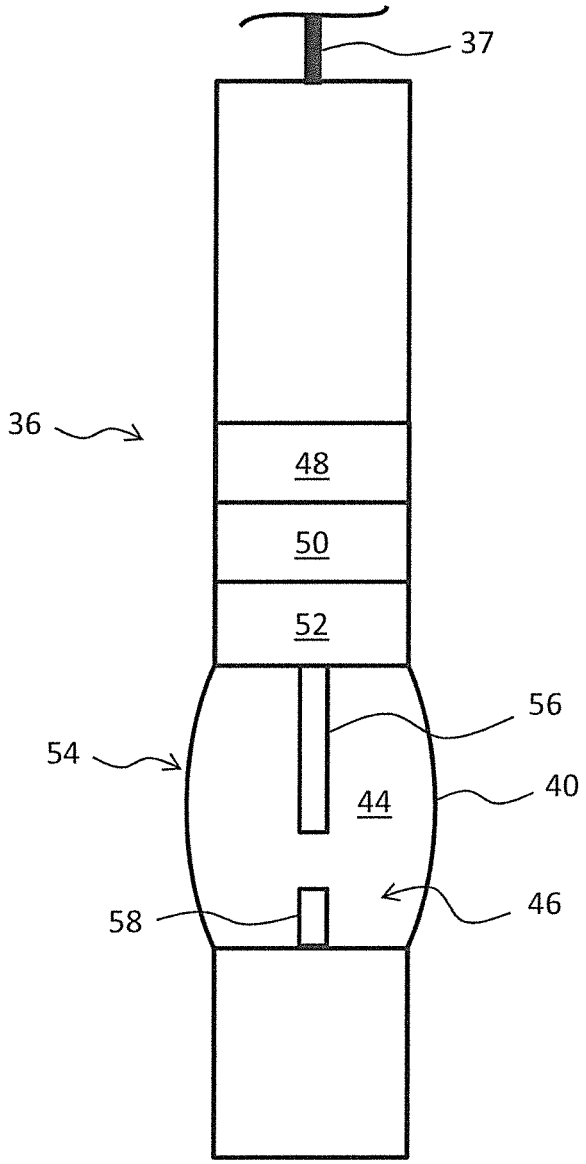
FIG. 3 illustrates schematically an embodiment of the shock wave generation device according to the invention.

As illustrated on FIG. 3, the shock wave generation device 36 is a source of electrohydraulic energy, which comprises a membrane 40 and an electrical discharge unit 42. The membrane 40 delimits a chamber 44 which is filled with a shock wave transmitting liquid 46. Such a membrane 40 isolates the liquid 46 in the chamber 44 from the completion string 22 while maintaining acoustic coupling with said completion string 22, improving the propagation of shockwaves while preventing external fluids from damaging the electrical discharge unit 42.

In a preferred embodiment, the membrane 40 is flexible in order to an efficient propagation of shock waves in many directions and prevent shock waves to bounce on it, allowing therefore an efficient conduction of the shock wave toward the surface-controlled subsurface safety valve 34, in particular toward the areas of the surface-controlled subsurface safety valve 34 which are accessible with difficulty or inaccessible.

To this end, the membrane 40 may be made of fluorine rubber or fluoroelastomer with a relative elongation of at least 150%, preferably at least 200% and being operable between −35° C. and 250° C.

The electrical discharge unit 42 is configured for generating a series of electrical discharges that propagate a series of shock waves into the shock wave transmitting liquid 46 and through the membrane 40 toward the surface-controlled subsurface safety valve 34 for removing of deposits 39 from said surface-controlled subsurface safety valve 34. The electrical discharge generating unit 42 may be configured to propagate shock waves radially or in a predetermined direction.

In this example, and as already describes in U.S. Pat. No. 4,345,650 issued to Wesley or U.S. Pat. No. 6,227,293 issued to Huffman, incorporated hereby by reference, the electrical discharge generating unit 42 comprises a power conversion unit 48, a power storage unit 50, a discharge control unit 52 and a discharge system 54. The discharge system 54 comprises a first electrode 56 and a second electrode 58 configured for triggering an electrical discharge.

The discharge system 54 comprises a plurality of capacitors (not represented) for storage of electrical energy configured for generating one or a plurality of electrical discharges into the shock wave transmitting liquid 46. The chamber 44 is delimited by the membrane 40 around the discharge system 54 which is filled with the shock wave transmitting liquid 46, allowing transmitting shock waves through the membrane 40 toward the surface-controlled subsurface safety valve 34.

Electrical power is supplied by the low voltage source 38 at a steady and relatively low power from the surface 16 through the wireline 37 to the downhole shock wave generation device 36. The power conversion unit 48 comprises suitable circuitry for charging of the capacitors in the power storage unit 50. Timing of the discharge of the energy in the power from the power storage unit 50 through the discharge system 54 is accomplished using the discharge control unit 52.

In a preferred embodiment, the discharge control unit 52 is a switch, which discharges when the voltage reaches a predefined threshold. Upon discharge of the capacitors in the power storage section through the first electrodes 56 and the second electrode 58 of the discharge control unit 52, electrohydraulic shock waves 60 (in reference to FIG. 2) are transmitted to the surface-controlled subsurface safety valve 34 for removing deposits 39.

Other designs of discharge unit 34 are disclosed in U.S. Pat. No. 6,227,293 issued to Huffman which is included hereby reference. According to the electrohydraulic effect, an electrical discharge is discharged in a very short time (few micro seconds) in the shock wave transmitting liquid 46.

Examples of Operation

Figure 4:
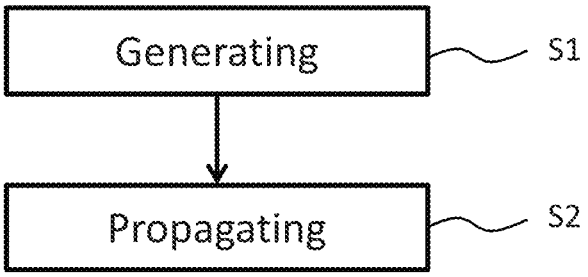
FIG. 4 illustrates an embodiment of the method according to the invention.

FIG. 4 illustrates an embodiment of the method for removing deposits 39 from a surface-controlled subsurface safety valve 34 of a completion string 22 arranged in a borehole 10 of a subterranean formation 1 according to the invention. Prior to operate the method according to the invention, the tubular surface-controlled subsurface safety valve 34, in particular its flapper valve 35, is at least partially blocked with deposits 39 (in reference to FIG. 2).

In a first step S1, a series of shock waves is generated into the shock wave transmitting liquid 46 nearby the surface-controlled subsurface safety valve 34. Then, in a second step S2, the series of shock waves is propagated through the membrane 25 toward the surface-controlled subsurface safety valve 34 for removing deposits 39 from said surface-controlled subsurface safety valve 34.

Preferably, the series of shock waves comprises at least ten shock waves, for example propagated at a periodic interval of time, e.g. every 5 to 20 seconds. A plurality of series may be advantageously repeated at different heights in the completion string 22 to remove deposits 39 from the different parts of the surface-controlled subsurface safety valve 34, in particular around the flapper valve 35 in areas which would be accessible with difficulty or inaccessible to a brush.

Figure 5:
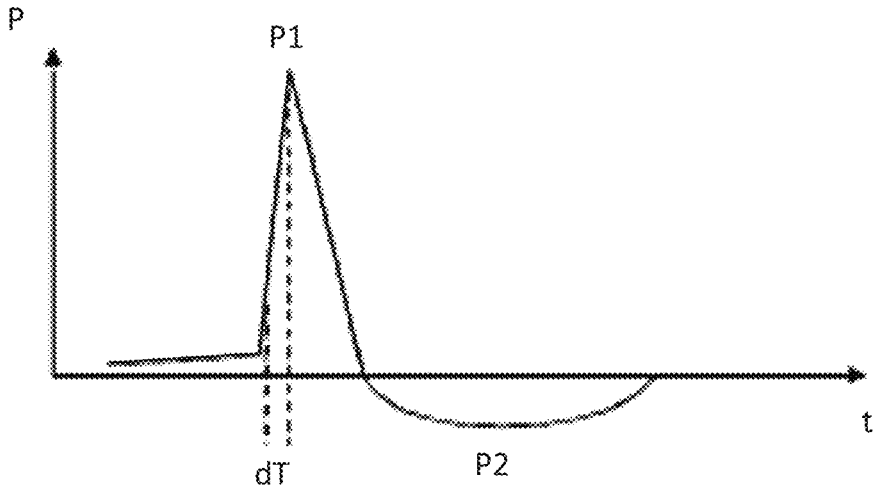
FIG. 5 shows the evolution of pressure with time of a shock wave generated by a shock wave generation device according to the invention.

FIG. 5 shows the variation of pressure with time nearby the surface-controlled subsurface safety valve 34. Firstly, the pressure generated by the shock wave increases in a very short time dT, e.g. a few microseconds, until a maximum P1. Such a peak phase characterizes a compression of the deposits 39. Then, the pressure generated by the shock wave decreases to a negative value P2 for a significant amount of time, e.g. a few milliseconds.

This second phase characterizes a traction effort applied on the deposits, which allows breaking deposits 39 in areas of the surface-controlled subsurface safety valve 34, in particular in areas which are accessible with difficulty or inaccessible to mechanical means, e.g. around the flapper valve 35. Such an traction effort is improved by the quality of propagation of the shock wave trough the shock wave transmitting liquid 46 and the membrane 40, allowing removing deposits 39 very efficiently.

Supplemental Equipment

Embodiments include many additional standard components or equipment that enables and makes operable the described device, process, method and system.

Operation, control and performance of portions of or entire steps of a process or method can occur through human interaction, pre-programmed computer control and response systems, or combinations thereof.

Experiment

Examples of specific embodiments facilitate a better understanding of deposits removing method and device. In no way should the Examples limit or define the scope of the invention.

This method shows good results as at least 95% of the deposits are removed from the surface-controlled subsurface safety valve 34.

Figure 6:
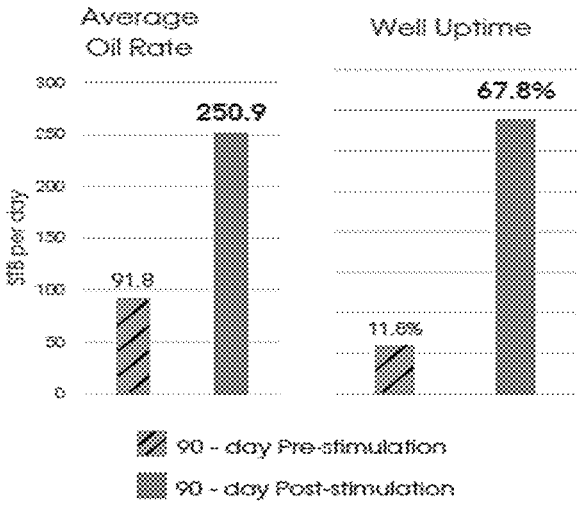
FIG. 6 shows a comparison of a 90-day pre-stimulation production period and a 90-day post-stimulation production period, said stimulation being performed using an embodiment of the shock wave generation device according to the invention.

FIG. 6 illustrates a comparison between a 90-day pre-stimulation production period and a 90-day post-stimulation production period, the stimulation having been completed using a shock wave generator according to the invention onto a surface-controlled subsurface safety valve 34 of a completion string 22 arranged in a well borehole 10 for oil production. After 90 days, the oil rate increases by a factor of 2.5 (two point five).

The invention is not limited to the described embodiment and can be applied to all type of formation fluids or gases transportation means.

The invention claimed is:

1. A method for removing deposits from a component of a production tubing string within a borehole performed by a shock wave generating device including deformable membrane delimiting at least partially a chamber which is at least partially filled with a shock wave transmitting liquid and which is adapted to be arranged into the production tubing string within the borehole, and an electrical discharge unit wherein the relative elongation of the membrane is at least 200%, said method comprising:

generating at least one shock wave into a shock wave transmitting liquid at least partially delimited by the deformable membrane into the production tubing string nearby the component using the electrical discharge unit of the shock wave generating device; and propagating the at least one shock wave through the deformable membrane at least partially delimiting the chamber of the shock wave generating device that is at least partially filled with the shock wave transmitting liquid toward the component for removing deposits from the component.

2. The method according to claim 1, wherein a series of at least ten shock waves is generated.

3. The method according to claim 2, wherein a plurality of series of shock waves is generated, each series of shock waves being generated at different locations of the the production tubing string.

4. The method according to claim 3, wherein the different locations are regularly spaced.

5. A shock wave generating device for removing deposits from a component of a production tubing string within a borehole, said device comprising:

a deformable membrane delimiting at least partially a chamber which is at least partially filled with a shock wave transmitting liquid and which is adapted to be arranged into the production tubing string nearby the component wherein a relative elongation of the deformable membrane is at least 200%; and an electrical discharge unit for generating at least one electrical discharge that propagates at least one shock wave into the shock wave transmitting liquid and through the deformable membrane nearby the component for removing deposits from the component.

6. The shock wave generation device according to claim 5, wherein the deformable membrane is deformable in order to conduct efficiently the shock wave toward the component.

7. The shock wave generation device according to claim 6, wherein the deformable membrane is made of at least one of fluorinated rubber and another fluoroelastomer.

8. The shock wave generation device according to claim 5, wherein the electrical discharge unit comprises a power conversion unit, a power storage unit, a discharge control unit and a discharge system.

9. The shock wave generation device according to claim 8, wherein the discharge system comprises a first electrode and a second electrode for generating a high voltage arc in the shock wave transmitting liquid.

10. The shock wave generation device according to claim 5, wherein the at least one shock wave propagates radially.

11. The shock wave generation device according to claim 5, wherein the at least one shock wave propagates in a predetermined direction.

12. A system for removing deposits from a component of a production tubing string within a borehole, the system comprising:

a shock wave generation device including:

a deformable membrane delimiting at least partially a chamber which is at least partially filled with a shock wave transmitting liquid and which is adapted to be arranged into the production tubing string nearby the component wherein a relative elongation of the deformable membrane is at least 200%, and an electrical discharge unit for generating at least one electrical discharge that propagates at least one shock wave into the shock wave transmitting liquid and through the deformable membrane nearby the component for removing deposits from the component;

a wireline coupled to the shock wave generation device for inserting the shock wave generation device in the production tubing string nearby the component;

a voltage source located external of the production tubing string; and an electrical circuit within the wireline for connecting the voltage source to the shock wave generation device.

13. A well for recovering formation fluids or gases from a subterranean formation comprising:

a completion string comprising at least one component;

a shock wave generation device including:

a deformable membrane delimiting at least partially a chamber which is at least partially filled with a shock wave transmitting liquid and which is adapted to be arranged into a production tubing string within a borehole nearby the component wherein a relative elongation of the deformable membrane is at least 200%, and an electrical discharge unit for generating at least one electrical discharge that propagates at least one shock wave into the shock wave transmitting liquid and through the deformable membrane nearby the component for removing deposits from the component;

a wireline coupled to the shock wave generation device for inserting the shock wave generation device in the production tubing string nearby the component;

a voltage source located external of the production tubing string; and an electrical circuit within the wireline for connecting the voltage source to the shock wave generation device.

14. A transportation pipeline within a borehole for transporting formation fluids or gases, comprising:

a component;

a shock wave generation device including:

a deformable membrane delimiting at least partially a chamber which is at least partially filled with a shock wave transmitting liquid and which is adapted to be arranged into the transportation pipeline nearby the component wherein a relative elongation of the deformable membrane is at least 200%, and an electrical discharge unit for generating at least one electrical discharge that propagates at least one shock wave into the shock wave transmitting liquid and through the deformable membrane nearby the component for removing deposits from the component;

a wireline coupled to the shock wave generation device for inserting the shock wave generation device in the transportation means nearby the component;

a voltage source located external of the transportation pipeline; and an electrical circuit within the wireline for connecting the voltage source to the shock wave generation device.

* * * * *